United States Patent [19]

Olander et al.

[11] 4,381,207

[45] Apr. 26, 1983

[54] PYROTECHNIC COMPOSITION

[75] Inventors: Donald E. Olander, Huntington Beach; Donald W. Petersen, Tehachapi, both of Calif.

[73] Assignee: Hi-Shear Corporation, Torrance, Calif.

[21] Appl. No.: 323,437

[22] Filed: Nov. 20, 1981

[51] Int. Cl.[3] ..... C06B 33/12

[52] U.S. Cl. ..... 149/40; 149/44

[58] Field of Search ..... 149/40, 44

[56] References Cited

U.S. PATENT DOCUMENTS 2,424,937 7/1947 Linzell ..... 149/37

*Primary Examiner*—Stephen J. Lechert, Jr.

*Attorney, Agent, or Firm*—Donald D. Mon

[57] ABSTRACT

A pyrotechnic composition produced by mixing and permitting to cure a mixture of aluminum, calcium sulfate, magnesium sulfate, and water. Increased heat output and density and improved ignitability result, while exotherm during curing can substantially be eliminated.

8 Claims, No Drawings

PYROTECHNIC COMPOSITION

FIELD OF THE INVENTION

This invention relates to pyrotechnic compositions based upon the reaction between aluminum and calcium sulfate.

BACKGROUND OF THE INVENTION

Aluminum and calcium sulfate incendiaries have been used for specialized purposes for a number of years. However, this mixture has never been used to a great extent for several reasons, each one being sufficient to prevent its general use. They are:

1. To obtain sufficient heat on a unit weight basis the amount of aluminum has to be increased to the point that ignition becomes too difficult.
2. During the curing exotherm some of the aluminum is attacked by the calcium sulfate water mixture used, with the evolution of hydrogen gas.
3. When the cast mixture is heated for an extended period of time at temperatures of 150° F. and higher, gas is evolved which in itself makes the material unsuitable for use in normal magazine conditions. In addition at least part of this gas is water of hydration from $CaSo_4.2H_2O$, the loss of which causes the physical properties of the cast material to deteriorate.
4. The cast material is too light. Therefore its volumetric loading efficiency is not adequate.

BRIEF DESCRIPTION OF THE INVENTION

This invention comtemplates the combination of aluminum, calcium sulfate and magnesium sulfate, together with such an amount of water as results in cured structure which while curing involved minimal exotherm, physical swelling, and gas evolution, in which the heat output and density are significantly increased relative to known aluminum/calcium sulfate compositions, and which are readily ignitable by suitable igniters.

This invention will be fully understood from the following detailed description of the invention.

DETAILED DESCRIPTION OF THE INVENTION

This invention comprises a cured product produced from a mixture of finely divided aluminum, calcium sulfate, and magnesium sulfate. Water is also a part of the initial mixture. Some of it may come from water of hydration of the sulfates. If an anhydrous salt is used, then make up water may be required.

The optimum cured composition utilizes about equal weights of aluminum and calcium sulfate (calculated as hemihydrate), together with magnesium sulfate (on a molar basis, about one-half the amount of calcium sulfate), together with about 6 moles of water for each mole of magnesium sulfate.

The aluminum may be reduced to a relative scale weight as low as about 15% aluminum to about 85% calcium sulfate, calculated as anhydrous, and the percentages range from about 15%/85% to about 60%/40% is useful.

To this material, the magnesium sulfate is added, preferably as a nearly-saturated solution. The amount of water used depends on whether the salts are anhydrous or hydrated, and on the properties to be attained. Each pour is a one-shot effort, and depending on the proportions and hydration of the salts used, different amounts of water will be used. In fact, excess water will bleed out of the cast material. After curing, water cannot be added to the cast material. Thus, a certain amount of trial and error cannot be avoided.

The optimum mixture to be cast is as follows:

Aluminum metal, fully divided, and calcium sulfate, anhydrous, in equal proportions;

Magnesium sulfate, anhydrous, in one half of the mole ratio of the calcium sulfate;

Water, 6 moles per mole of the magnesium sulfate, plus water needed to allow for proper mechanical mixing.

The materials are mixed together and cast to a desired shape. The water is best supplied as a solvent for the magnesium sulfate. The mixture will then begin to cure. Surprisingly, there will be little or no exotherm. In fact, occasionally the curing reaction may be endothermic. The amount of water best to be used will be selected after a few experiments.

Whatever the selection, it results in minimal gas evolution, and minimal swelling. The heat output of the cured product is remarkably high, as is its density.

The burning rate can be controlled and the physical strength can be increased by addition of glycerin to the mixture. This is best added to the magnesium sulfate solution prior to mixing with the dry ingredients. It has been found that at 4.0% by weight of the *cured* mixture, glycerin will exude from the cast material during curing. Up to that point, glycerin will decrease the burning rate and increase the physical strength. About 1% is optimum.

There is no loss of weight or of physical properties after the curing, even when the product is stored at 225° F. for extended periods of time.

This product can be initiated by a suitable igniter. Because of its stable properties and of the high temperatures it generates, this pyrotechnic is usable in personnel-occupied working areas. For example, it is excellent for the quick destruction of files or documents.

This invention is not to be limited by the embodiments that are given by way of example, and not of limitation, but only in accordance with the scope of the appended claims.

We claim:

1. A pyrotechnic product produced by mixing fully divided aluminum metal, calcium sulfate, magnesium sulfate, and water, the weight ratio of aluminum to calcium sulfate hemihydrate being between about 15%/85% to about 60%/40%, the magnesium sulfate being in the molar ratio relative to calcium sulfate of about 1/2, and about 6 moles of water per mole of magnesium sulfate, all of the foregoing ratios being based upon anhydrous sulfates, the calcium sulfate being calculated as hemihydrate.

2. A pyrotechnic product according to claim 1 in which glycerin comprises up to about 4.0% of the weight of the cured product.

3. A pyrotechnic product according to claim 1 in which the weight ratio of aluminum to calcium sulfate hemihydrate is about 50%/50%.

4. A pyrotechnic product according to claim 3 in which glycerin comprises up to about 4.0% of the weight of the cured product.

5. A pyrotechnic product according to claim 2 in which the glycerin percentage is about 1.0.

6. A pyrotechnic product according to claim 4 in which the glycerin percentage is about 1.0.

7. A pyrotechnic product produced by mixing fully divided aluminum metal, calcium sulfate, and water, the weight ratio of aluminum to calcium sulfate hemihydrate being between about 15%/85% to about 60%/40%, and water sufficient for mechanical mixing, the calcium sulfate being calculated as hemihydrate.

8. A pyrotechnic product according to claim 7 in which the weight ratio of aluminum to calcium sulfate hemihydrate is about 50%/50%.

* * * * *